US006209649B1

(12) United States Patent
Pringle et al.

(10) Patent No.: US 6,209,649 B1
(45) Date of Patent: Apr. 3, 2001

(54) SELECTIVE RE-ENTRY TOOL FOR MULTIPLE TUBING COMPLETIONS AND METHOD OF USING

(75) Inventors: Ronald E. Pringle, Houston; Clay W. Milligan, Jr., Missouri City; Dwayne D. Leismer, Pearland, all of TX (US)

(73) Assignee: Camco International, Inc, Houston, TX (US)

( * ) Notice: Subject to any disclaimer, the term of this patent is extended or adjusted under 35 U.S.C. 154(b) by 0 days.

(21) Appl. No.: 09/371,775

(22) Filed: Aug. 10, 1999

(51) Int. Cl.[7] ..... E21B 43/14

(52) U.S. Cl. ..... 166/313; 166/117.9; 166/237; 166/378

(58) Field of Search ..... 166/50, 117.5, 166/117.6, 237, 242.3, 313, 378, 380, 381; 175/61, 79, 82

(56) References Cited

U.S. PATENT DOCUMENTS

| | | | | |
|---|---|---|---|---|
| 2,492,079 | | 12/1949 | Wiley . | |
| 3,170,518 | | 2/1965 | Brown . | |
| 3,330,349 | | 7/1967 | Owsley et al. . | |
| 4,396,230 | | 8/1983 | Wood et al. . | |
| 4,444,276 | | 4/1984 | Peterson, Jr. . | |
| 4,807,704 | | 2/1989 | Hsu et al. . | |
| 5,137,090 | | 8/1992 | Hare et al. . | |
| 5,318,121 | | 6/1994 | Brockman et al. . | |
| 5,325,924 | | 7/1994 | Bangert et al. . | |
| 5,330,007 | | 7/1994 | Collins et al. . | |
| 5,427,177 | | 6/1995 | Jordan, Jr. et al. . | |
| 5,454,430 | | 10/1995 | Kennedy et al. . | |
| 5,474,131 | | 12/1995 | Jordan, Jr. et al. . | |
| 5,531,270 | | 7/1996 | Fletcher et al. . | |
| 5,533,573 | | 7/1996 | Jordan, Jr. et al. . | |
| 5,564,503 | | 10/1996 | Longbottom et al. . | |
| 5,566,763 | * | 10/1996 | Williamson et al. | 166/313 X |
| 5,615,740 | * | 4/1997 | Comeau et al. | 166/380 |
| 5,651,415 | | 7/1997 | Scales . | |
| 5,685,373 | | 11/1997 | Collins et al. . | |
| 5,697,445 | | 12/1997 | Graham . | |
| 5,715,891 | | 2/1998 | Graham . | |
| 5,785,133 | | 7/1998 | Murray et al. . | |
| 5,806,614 | | 9/1998 | Nelson . | |
| 5,845,707 | | 12/1998 | Longbottom . | |
| 5,845,710 | | 12/1998 | Longbottom et al. . | |
| 5,878,815 | | 12/1999 | Collins . | |
| 5,884,704 | | 3/1999 | Longbottom et al. . | |
| 5,918,669 | * | 7/1999 | Morris et al. | 166/50 |
| 5,941,308 | * | 8/1999 | Malone et al. | 166/313 |
| 6,012,527 | * | 1/2000 | Nitis et al. | 166/313 |

FOREIGN PATENT DOCUMENTS

| | | |
|---|---|---|
| WO 98/45570 | 10/1998 | (WO) . |
| WO 98/57031 | 12/1998 | (WO) . |
| WO 99/24689 | 5/1999 | (WO) . |

* cited by examiner

*Primary Examiner*—George Suchfield
(74) *Attorney, Agent, or Firm*—Goldstein & Healey LLP

(57) ABSTRACT

A selective re-entry tool is provided that allows an operator at the earth's surface to perform intervention operations in one or more completion strings by allowing remote discrimination and orientation of a tool string to a target location in a single comingling completion string. The selective re-entry tool may broadly include a carrier body having a navigation port extending longitudinally therethrough, and an orienting key movably connected to the carrier body and releasably engageable with a discriminator groove in a tubing string to align the navigation port with a predetermined one of a plurality of branch tubings in the tubing string. The re-entry tool may further include a locking dog movably connected to the carrier body and releasably engageable with a locking recess in the tubing string to prevent rotation of the carrier body after the navigation port has been aligned with the predetermined one of the plurality of branch tubings. A method of aligning a navigation port and/or tool string with a specific downhole tubing string or lateral well branch is also provided.

20 Claims, 16 Drawing Sheets

SELECTIVE RE-ENTRY TOOL FOR MULTIPLE TUBING COMPLETIONS AND METHOD OF USING

BACKGROUND OF THE INVENTION

1. Field of the Invention

The present invention relates to subsurface well equipment in wellbores having a plurality of production tubing strings and, more particularly, to an apparatus for selection of and entry into a particular tubing string by a re-entry device and a related method.

2. Description of the Related Art

Wells having a central bore and lateral branches extending therefrom, and extending into the hydrocarbon producing subterranean formations are well known as "multilateral wells." Also well known in the art are "dual completions," i.e., wells having a plurality of production tubing strings to carry hydrocarbons from subterranean producing zones via discrete and corresponding tubing strings to the surface of the earth. During the life of a well, remediation of one or more producing zones may be required by a technique commonly known as "wireline or coiled tubing intervention," whereby a well known intervention tool is lowered into the well on a small diameter wire or coiled tubing, and a service operation is performed that improves production, collects data, or performs operations critical to the well's performance.

Well known to those of ordinary skill in the art are two basic types of "wireline" tools: electric line (commonly called "e-line") and slickline. E-line tools require a multifunctional wire, whereby in addition to suspending and conveying the tool to a specific location in a well, the e-line is also used to transmit power from the surface to the intervention tool and/or transmit data between the surface and the intervention tool. Conversely, slickline tools use a simple wire to suspend and convey the tool to its selected location, and are designed to require no electrical power from the surface to perform their designed function. One of ordinary skill in the art will immediately appreciate the difficulty of both types of wireline tools in selecting a particular branch lateral wellbore extending from a central wellbore, where at least one lateral branch is present. As noted above, coiled tubing, as opposed to wireline, is also commonly used to run intervention tools into wells.

Well known in the art of completion techniques are methods and associated completion equipment for "tieing-back" or connecting two production tubing strings, attached to a permanent downhole tubing hanger, to a subsea christmas tree. The ability to manipulate a tie-back string so that it reliably and accurately aligns with one of a plurality of production strings located a distance in the well below the christmas tree illustrates the importance of downhole orientation. It is essential to well operations to be able to select and interconnect the production tubing strings to a respective location and orientation of flow lines in the tree. The tie-back string is essentially a spool connecting the tubing hanger to the christmas tree, and enables discrimination between tubing fixed in the downhole tubing hanger, and flow ports in the christmas tree.

In most dual completions, a first length of production tubing extends from a first producing zone to the tree and a second length of production tubing extends from a second producing zone to the tree. Therefore, a selection of the desired tubing string for intervention is often as simple as inserting the intervention tool directly or indirectly into the tubing via a device known as a "lubricator." The lubricator sealably connects to the tree, and allows insertion of the intervention tool in the wellbore while simultaneously preventing the flow of pressurized wellbore fluids into the surrounding environment. In the case of multiple tubing strings and flow lines, the lubricator must be connected separately to each flow line if intervention techniques are to be employed.

When remediation or service is required in multilateral and dual completion wells, the operator must select and enter the proper branch of the well, or completion string, and simply and reliably enable a service tool to be conveyed therein. An object of the present invention is to enable the operator to simply and easily make a configurational modification to the intervention tool at the surface prior to deployment. This modification enables the invention to enter a selected branch of a multilateral wellbore or a dual completion. Another object of the invention is to simplify the configuration of the completion. By eliminating expensive components, initial costs can be minimized, thereby making the well more cost effective to deploy and operate.

There is a need for a selective re-entry tool for use in wells having a plurality of tubing strings and which has the ability to discriminate between the strings and to reliably orient a service tool string for entry into a desired lateral branch. This need may exist, for example, where the tubing entry point is at a depth below the wellhead, possibly very deep in the well. There is also a need to accomplish discrimination and selection functions with a simple surface modification to the intervention tool that will result in cost savings in the design, operation, and implementation of the well. Further, it is desirable to eliminate the need for a "tie-back" tubing string for intervention operations and the high costs associated with building and deploying it.

SUMMARY OF THE INVENTION

The present invention has been contemplated to meet the above described needs. In a broad aspect, the invention may be a selective re-entry tool for use in a tubing string having a plurality of branch tubings, comprising: a carrier body having a navigation port extending longitudinally therethrough; and an orienting key movably connected to the carrier body and releasably engageable with a discriminator groove in the tubing string to align the navigation port with a predetermined one of the plurality of branch tubings. Another feature of this aspect of the present invention may be that the orienting key is adapted to be removably disposed within one of a plurality of key recesses in the carrier body, the identity of the predetermined one of the plurality of branch tubings alignable with the navigation port depending on which of the plurality of key recesses the orienting key is disposed in. Another feature of this aspect of the present invention may be that the orienting key is hingedly connected to the carrier body. Another feature of this aspect of the present invention may be that the orienting key is outwardly biased by a spring. Another feature of this aspect of the present invention may be that the tool may further include a locking dog movably connected to the carrier body and releasably engageable with a locking recess in the tubing string to prevent rotation of the carrier body after the navigation port has been aligned with the predetermined one of the plurality of branch tubings. Another feature of this aspect of the present invention may be that the locking dog is adapted to be removably disposed within one of a plurality of dog recesses in the carrier body. Another feature of this aspect of the present invention may be that the locking dog is outwardly biased by a spring. Another feature of this aspect of the present invention may be that the engagement of the locking dog and the locking recess prohibits further rotation of the carrier body relative to the tubing string and permits limited longitudinal movement of the carrier body relative to the tubing string. Another feature of this aspect of the present invention may be that the tool may further include a guide bar extending from the carrier body in alignment with the navigation port. Another feature of this aspect of the present invention may be that the carrier body further includes a no-go process cooperably engageable with a no-go shoulder in the tubing string.

In another aspect, the invention may be a method for inserting a well tool in a selected one of a plurality of branch tubings in a tubing string, comprising: connecting an orienting key to a carrier body, the carrier body having at least one navigation port extending longitudinally therethrough; positioning the carrier body in the tubing string; engaging the orienting key with a discriminator groove in the tubing string; rotating the carrier body to align the at least one navigation port with the selected one of the plurality of branch tubings; and passing the well tool through the navigation port and into the selected one of the plurality of branch tubings. Another feature of this aspect of the present invention may be that the method may further include attaching a locking dog to the carrier body; and engaging the locking dog with a locking recess in the tubing string to maintain alignment between the at least one navigation port and the selected one of the plurality of branch tubings. Another feature of this aspect of the present invention may be that the method may further include pulling the well tool up into the navigation port; removing the carrier body and well tool from the tubing string; disconnecting the orienting key from the carrier body; connecting the orienting key to a different position on the carrier body; positioning the carrier body back into the tubing string; engaging the orienting key with a discriminator groove in the tubing string; rotating the carrier body to align the at least one navigation port with another selected one of the plurality of branch tubings; and passing the well tool through the navigation port and into the another selected one of the plurality of branch tubings.

In another aspect, the present invention may be a wireline discriminator apparatus, comprising: a production tubing having a plurality of branch tubings; a carrier body having a navigation port extending longitudinally therethrough and adapted to be selectively positioned within the production tubing; and an alignment mechanism adapted to selectively align the navigation port with a selected one of the plurality of lower tubings.

In another aspect, the present invention may be a selective re-entry tool for use in a tubing string having a plurality of branch tubings, the re-entry tool comprising: a carrier body having a plurality of navigation ports extending longitudinally therethrough, the number of navigation ports being equal to the number of branch tubings; and an orienting key movably connected to the carrier body and releasably engageable with a discriminator groove in the tubing string to align the plurality of navigation ports with the plurality of branch tubings. Another feature of this aspect of the present invention may be that the tool may further include a locking dog movably connected to the carrier body and releasably engageable with a locking recess in the tubing string to prevent rotation of the carrier body after the plurality of navigation ports has been aligned with the plurality of branch tubings. Another feature of this aspect of the present invention may be that the engagement of the locking dog and the locking recess prohibits further rotation of the carrier body relative to the tubing string and permits limited longitudinal movement of the carrier body relative to the tubing string. Another feature of this aspect of the present invention may be that the locking dog is outwardly biased by a spring. Another feature of this aspect of the present invention may be that the carrier body further includes a no-go process cooperably engageable with a no-go shoulder in the tubing string. Another feature of this aspect of the present invention may be that the orienting key is hingedly connected to the carrier body. Another feature of this aspect of the present invention may be that the orienting key is outwardly biased by a spring.

BRIEF DESCRIPTION OF THE DRAWINGS

Other features and advantages of the present invention will become more fully apparent from the following detailed description, appended claims, and the accompanying drawings in which:

Figure 1A:
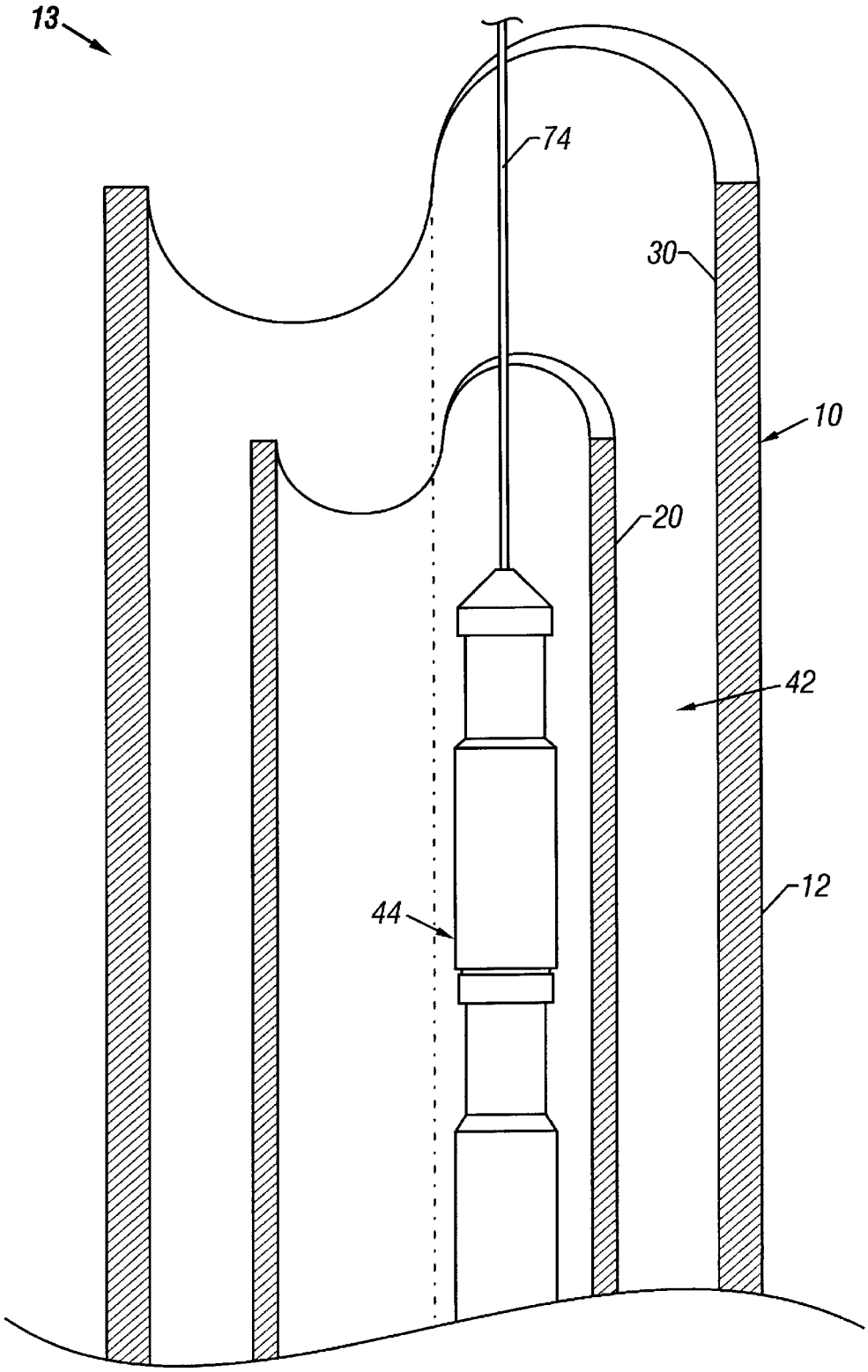
FIGS. 1A–1H illustrate a longitudinal cross-sectional view of the present invention shown in a well configuration.
Figure 1B:
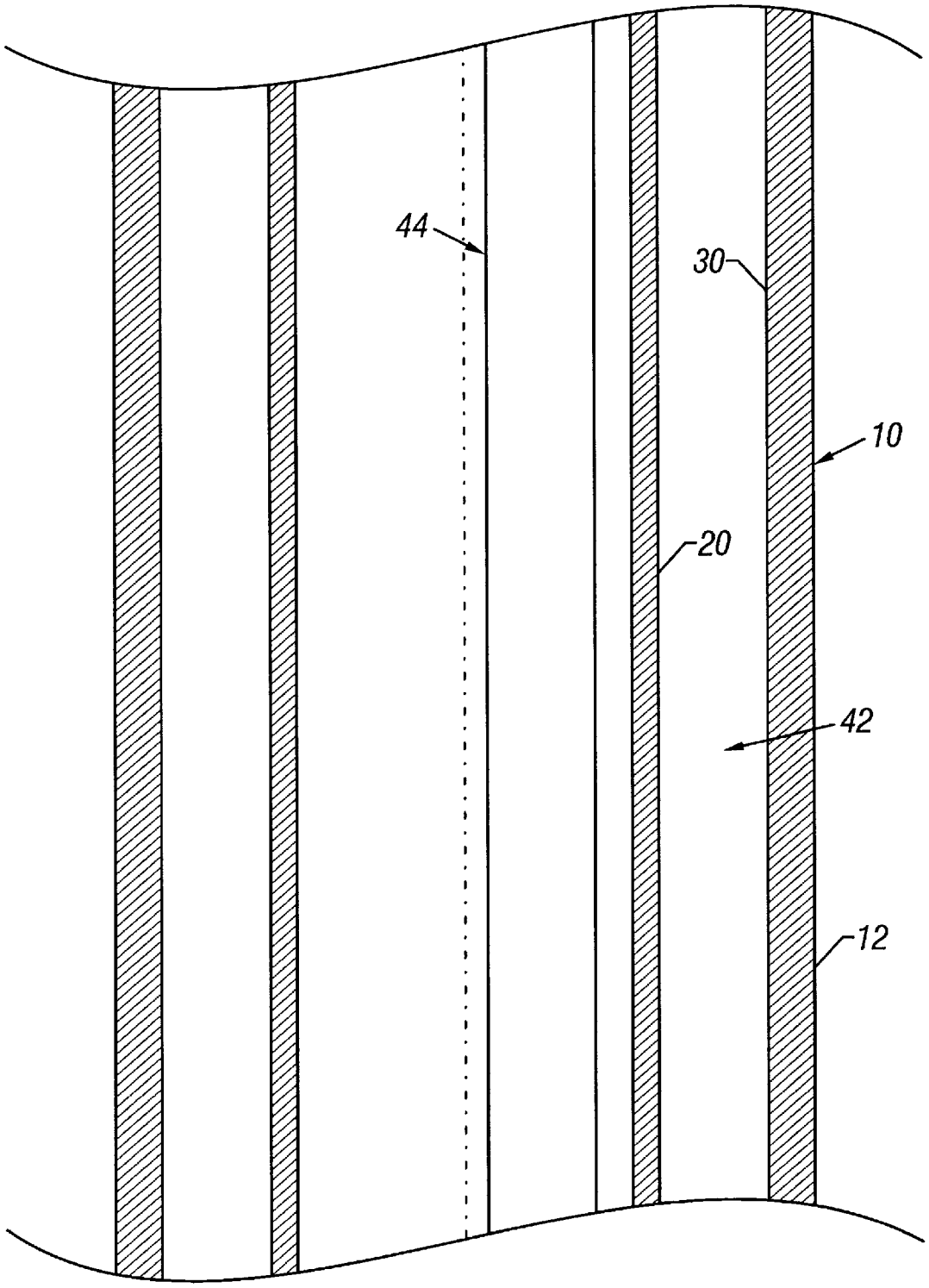
Figure 1C:
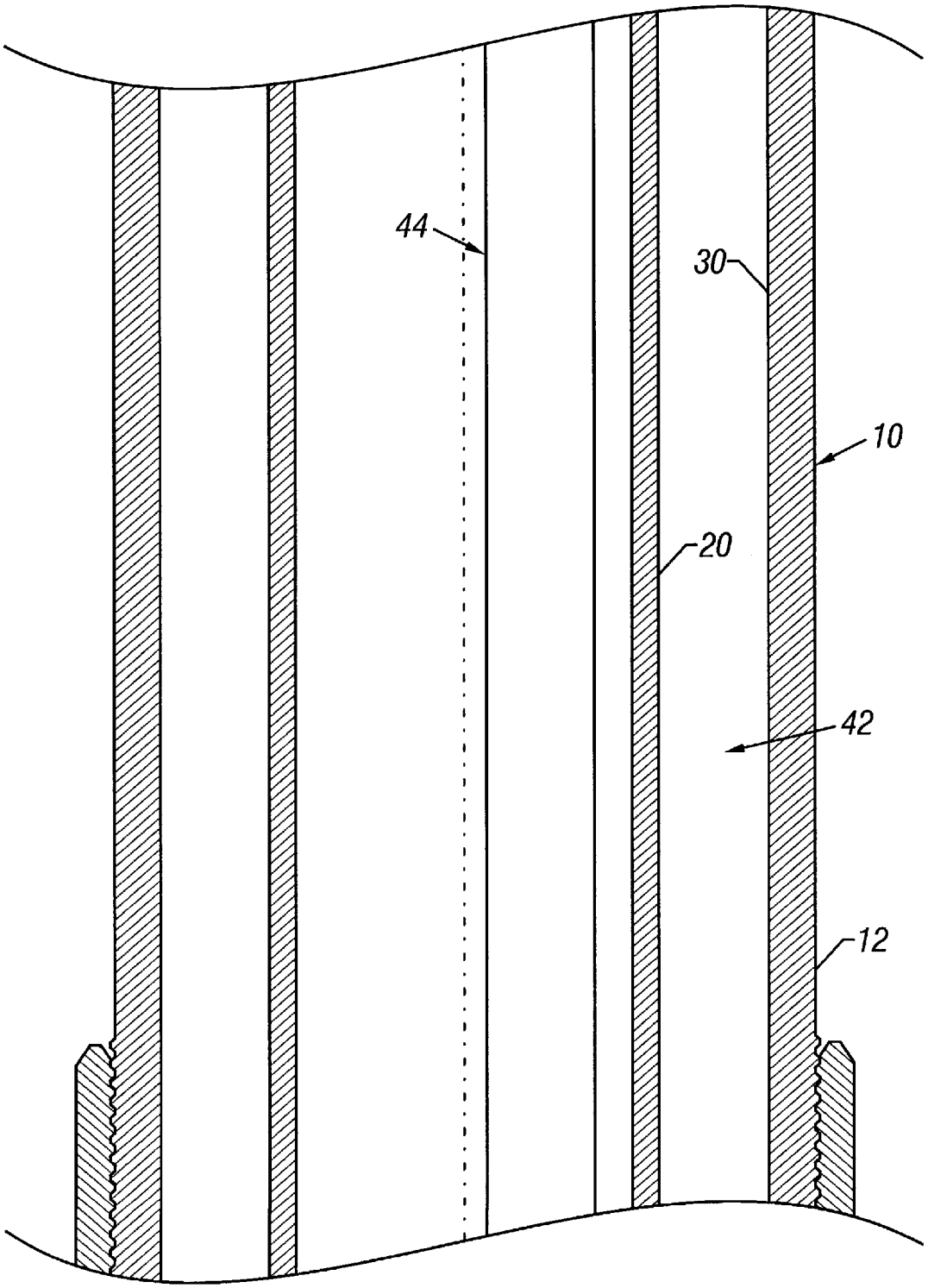
Figure 1D:
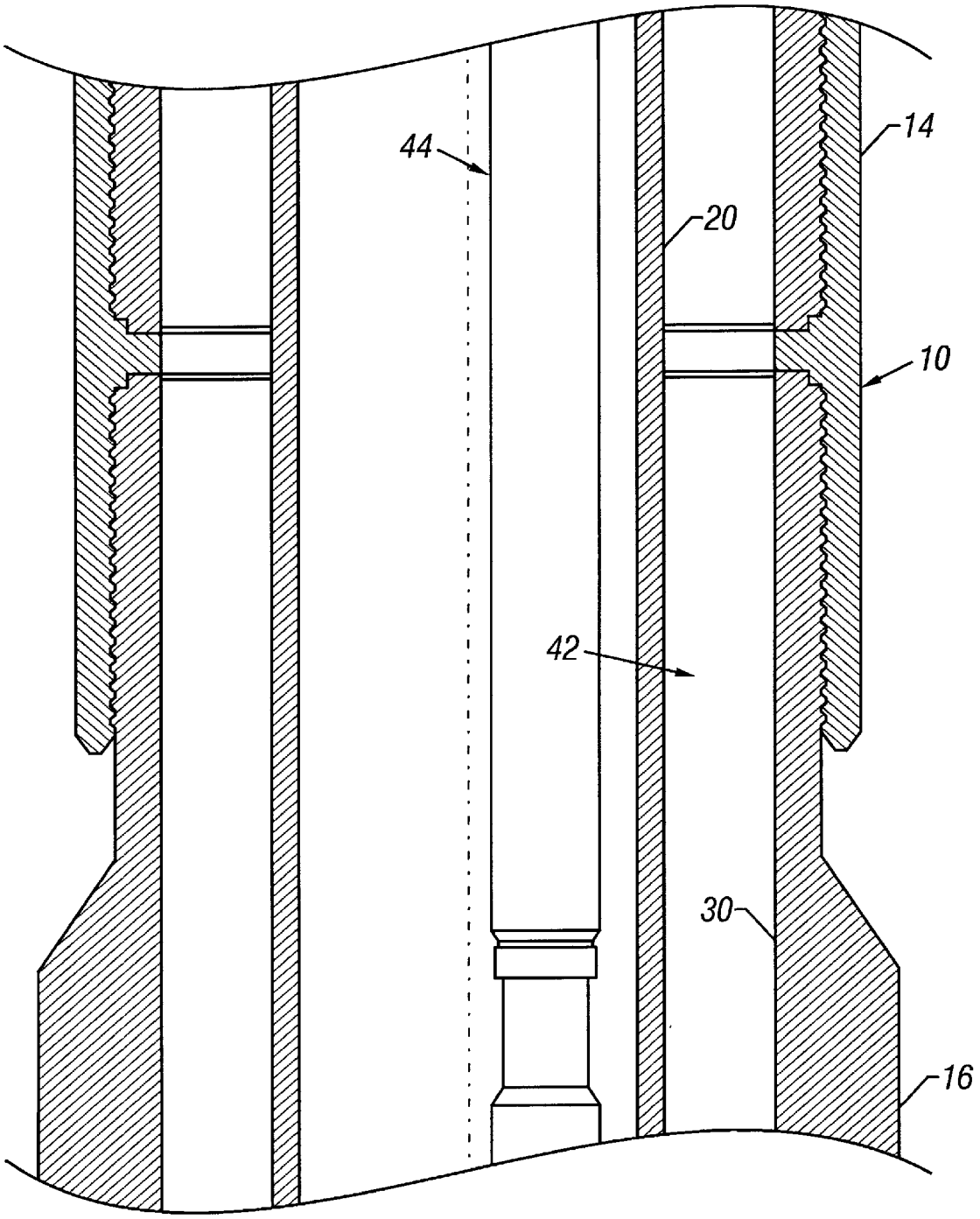

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE PREFERRED EMBODIMENTS

The present invention is a selective re-entry tool that may be used in at least two types of wells: (1) wells having a central bore and at least one lateral branch (multilateral completions); and (2) wells having a single borehole and a plurality of tubing strings (dual completions). The tool allows an operator at the earth's surface to perform intervention operations in one or more completion strings by allowing remote discrimination and orientation of a service tool string to a target location in a single commingling completion string. The present invention is applicable, at a minimum, intervention tools of the type operated with coiled tubing, "slickline" and "e-line." A benefit derived from the use of the tool of the present invention in wells having a plurality of tubing strings or lateral branches includes the ability to discriminate between multiple strings or lateral branches and to reliably orient the service tool string for entry into a chosen string or lateral branch. As such, the present invention simplifies the completion design and reduces costs associated therewith.

For the purpose of this discussion, the terms "upper", "lower", "uphole", and "downhole" are relative terms to indicate position and direction of movement in easily recognized terms. Usually these terms are relative to a line drawn perpendicularly downward from the center of the borehole at the earth's surface, and would be appropriate for use in straight, relatively vertical wellbores. However, when the wellbore is highly deviated, such as from about horizontal to about 60 degrees from vertical, or if there are multiple laterals, these usually comfortable terms to persons skilled in the art may not make sense. Use of these terms are for ease of understanding as an indication to what relative position or movement would be if the well were vertical, and should not be construed to limit the scope of the invention.

Referring to the drawings in detail, wherein like numerals denote identical elements throughout the several views, a casing string 10 in which the present invention may be used is shown in FIGS. 1A–1H. As shown in FIGS. 1A–1E, the casing string 10 may include a first casing 12 sealably and threadably attached to a casing nipple 14, a casing adapter 16 which in this embodiment serves to enlarge an inside diameter 30 of the assembled casing string 10, and a second casing 18 (FIGS. 1F–1H) sealably and threadably attached to the casing adapter 16. The casing string 10 defines a central wellbore 13 (see FIG. 1A).

As shown in FIGS. 1A–1D, a primary production tubing 20 is disposed within the casing string 10 and serves to convey hydrocarbons produced from a subterranean formation to the earth's surface. As shown in FIGS. 1E–1F, the primary production tubing 20 may be sealably and threadably attached to a tubing nipple 22. As shown in FIGS. 1E–1G, the tubing nipple 22 may include a mechanical stop, such as a no-go shoulder 32, and may be sealably and threadably attached to an orientation sub 24. As shown in FIG. 1H, the orientation sub 24 may be attached, such as by welding, to a tubing extension 34. As shown in FIG. 1L, the tubing extension 34 may be similarly attached to a Y-block adapter 36. The Y-block adapter 36 functions to converge at least two tubing branches, illustrated in this embodiment as a first branch tubing 26 and a second branch tubing 28, which sealably attach in a first bore 38 and a second bore 40, formed longitudinally through the Y-block adapter 36, respectively. The casing string 10 and the primary tubing string 20 define an annulus 42, which in operation is commonly filled with brine.

Figure 1E:
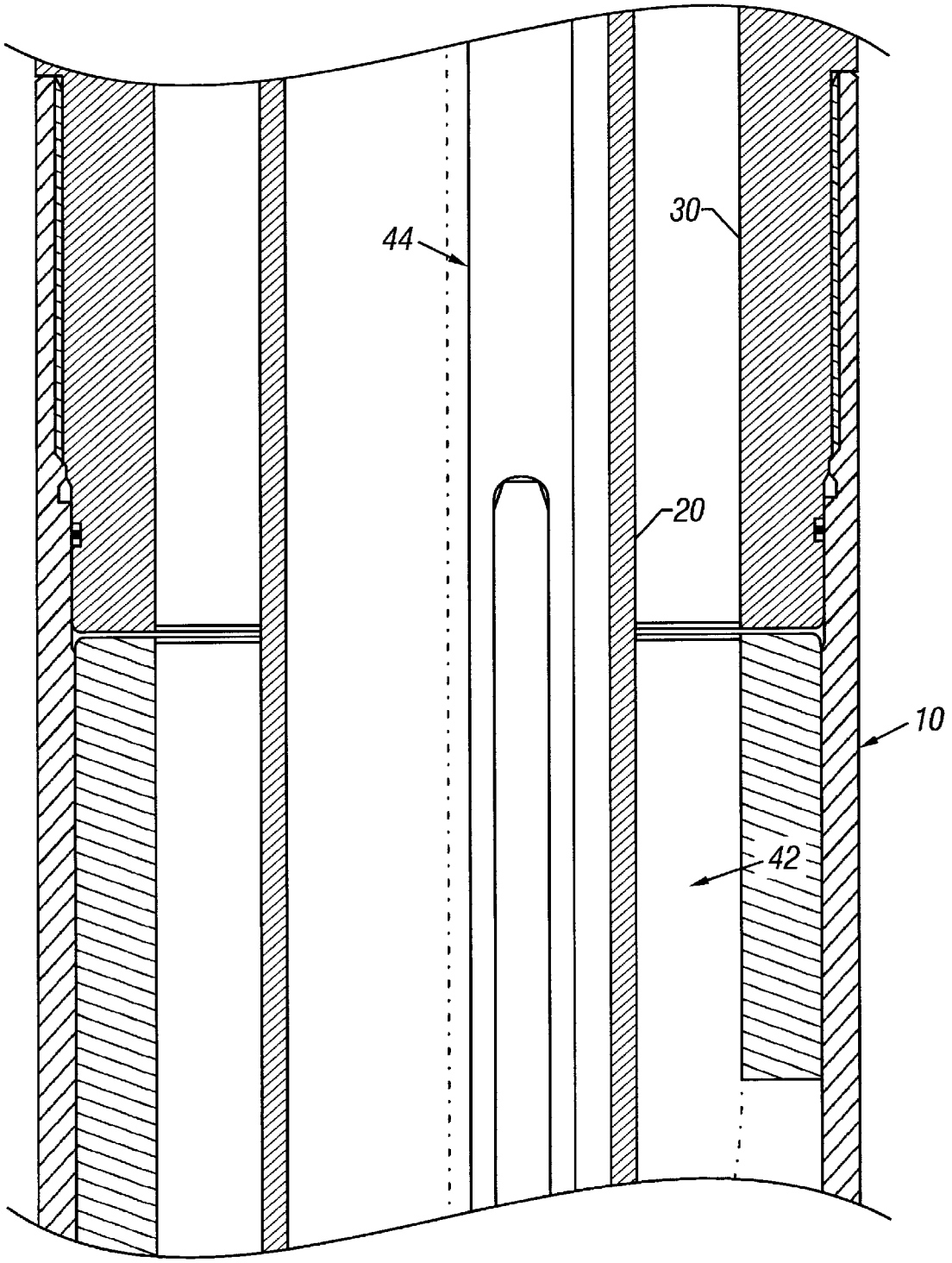
Figure 1F:
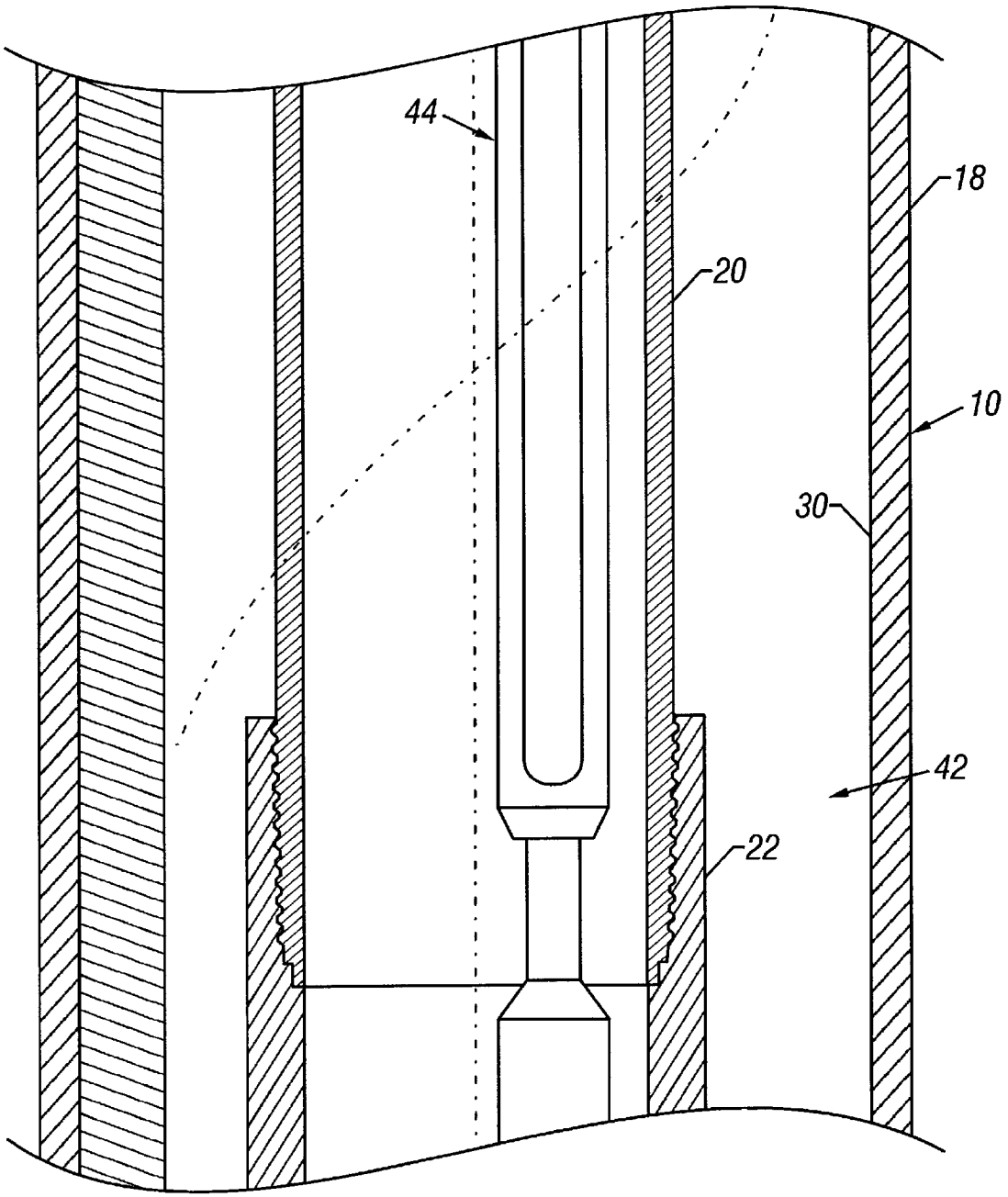
Figure 1G:
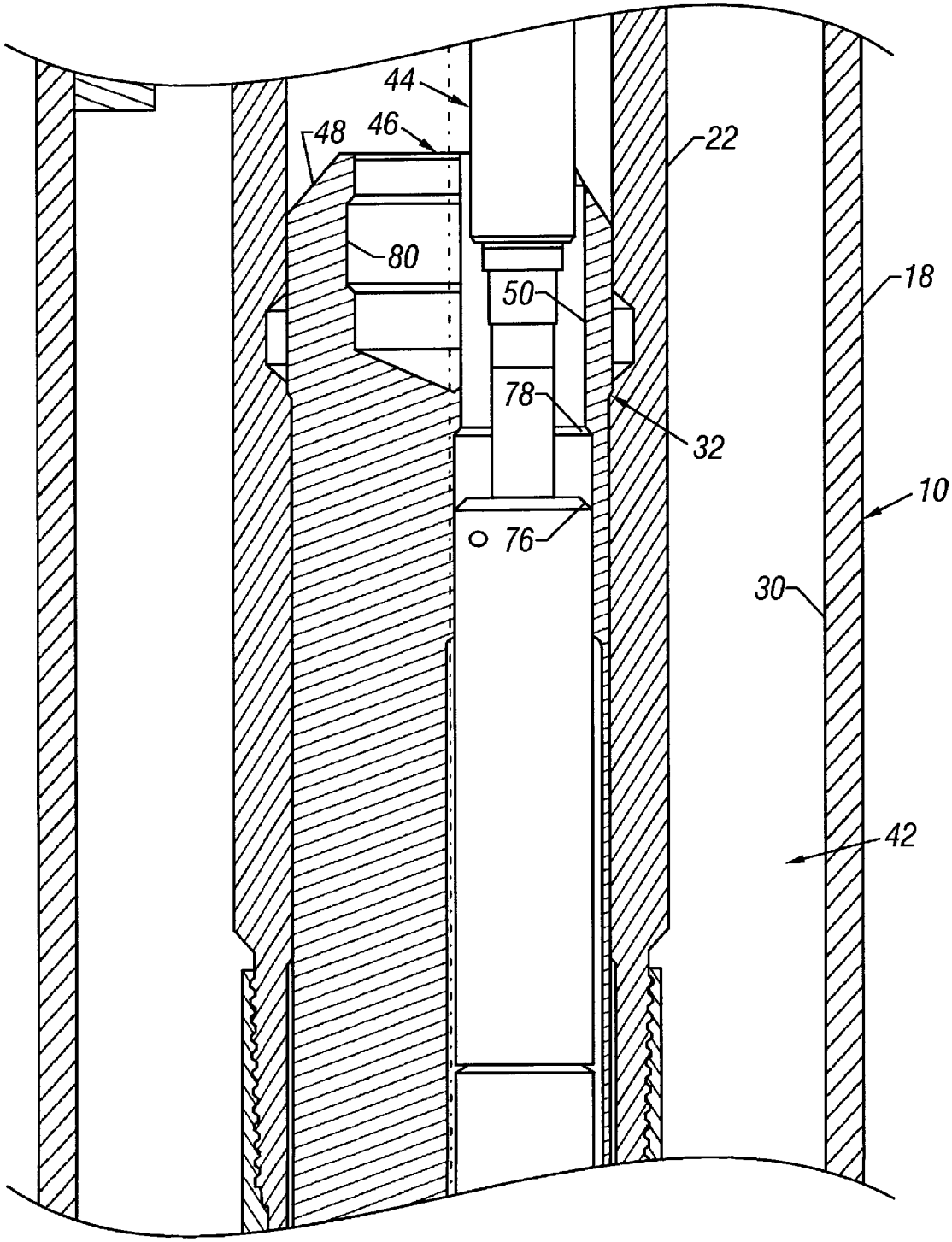
Figure 1H:
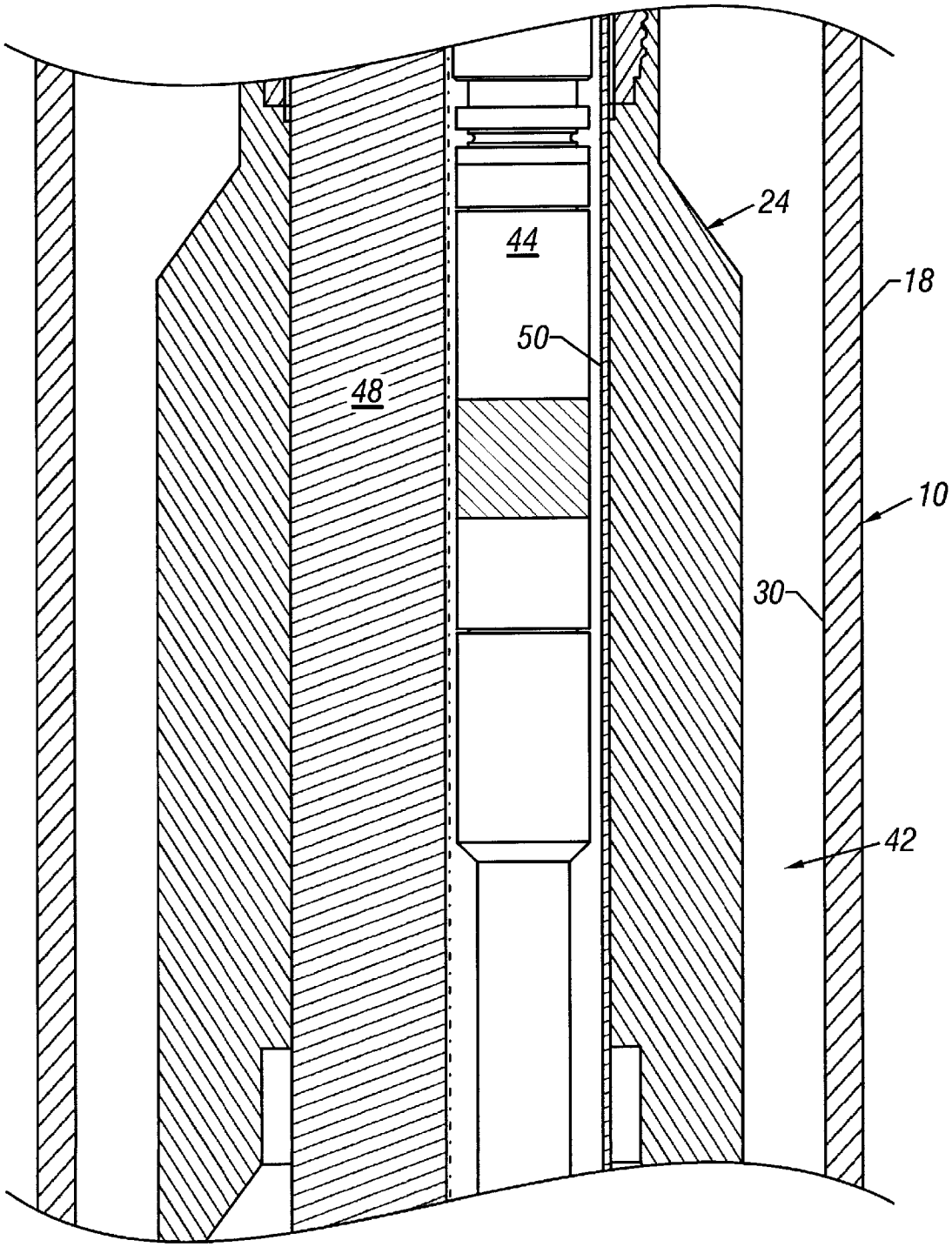
Figure 1I:
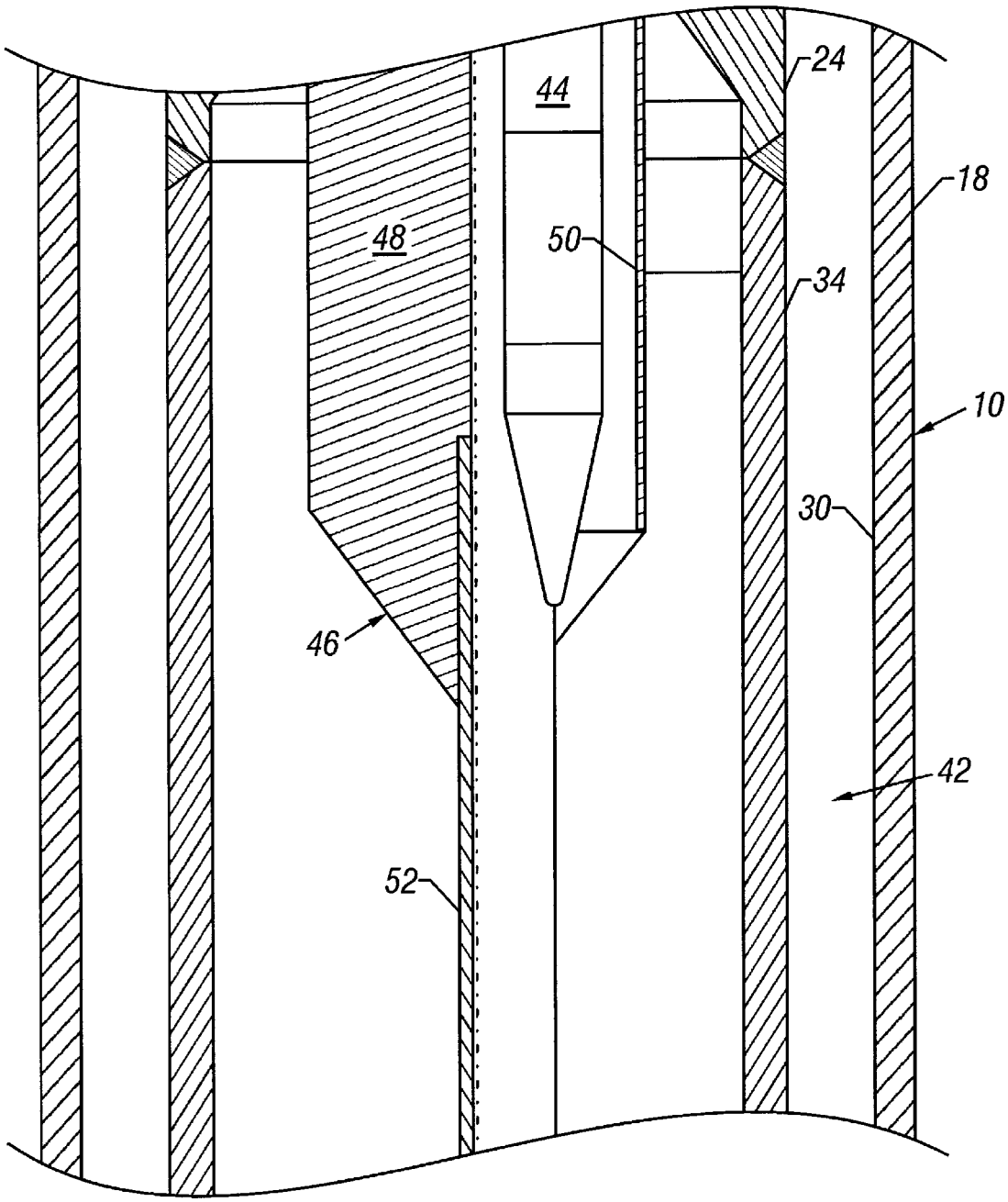
Figure 1J:
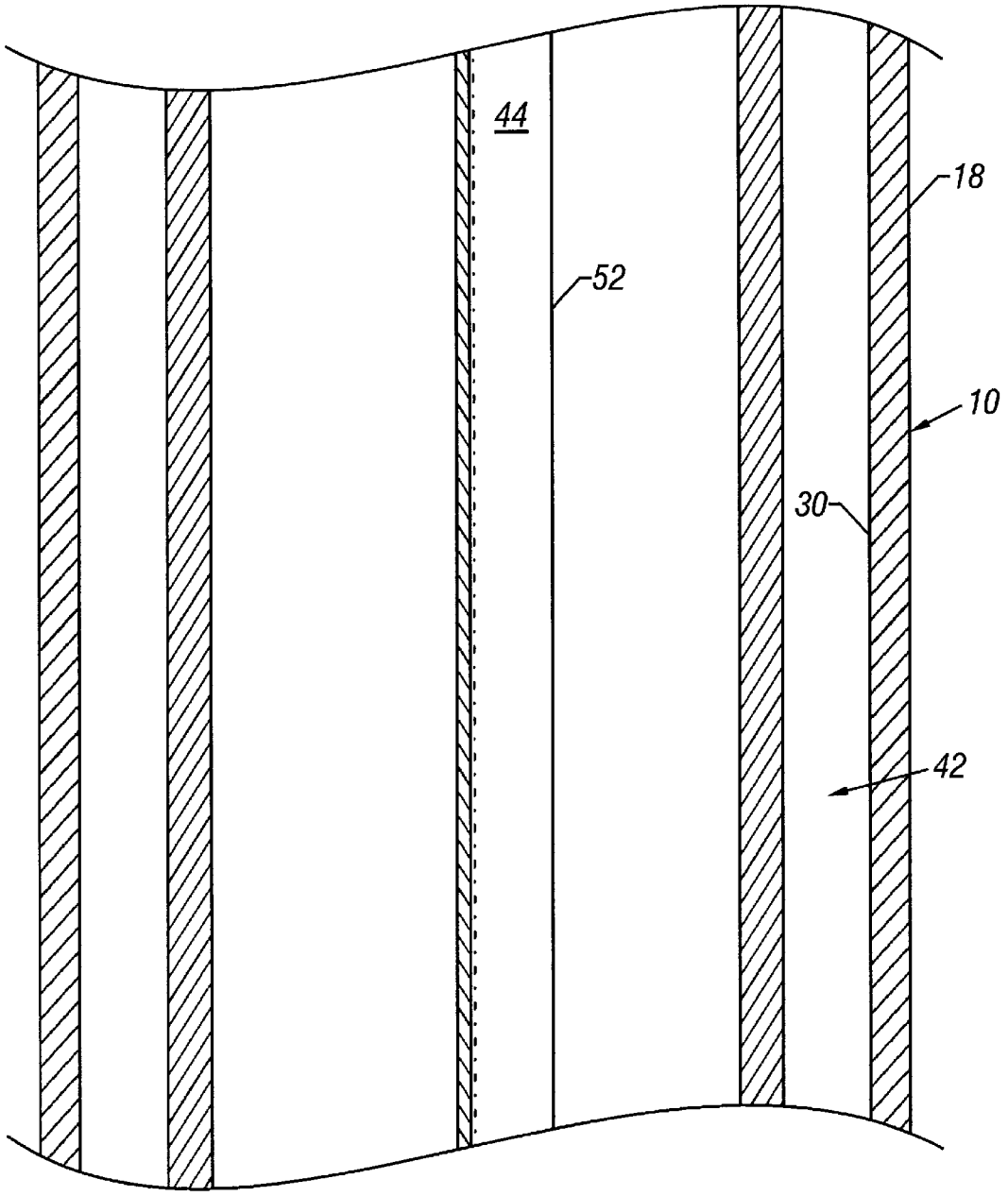
Figure 1K:
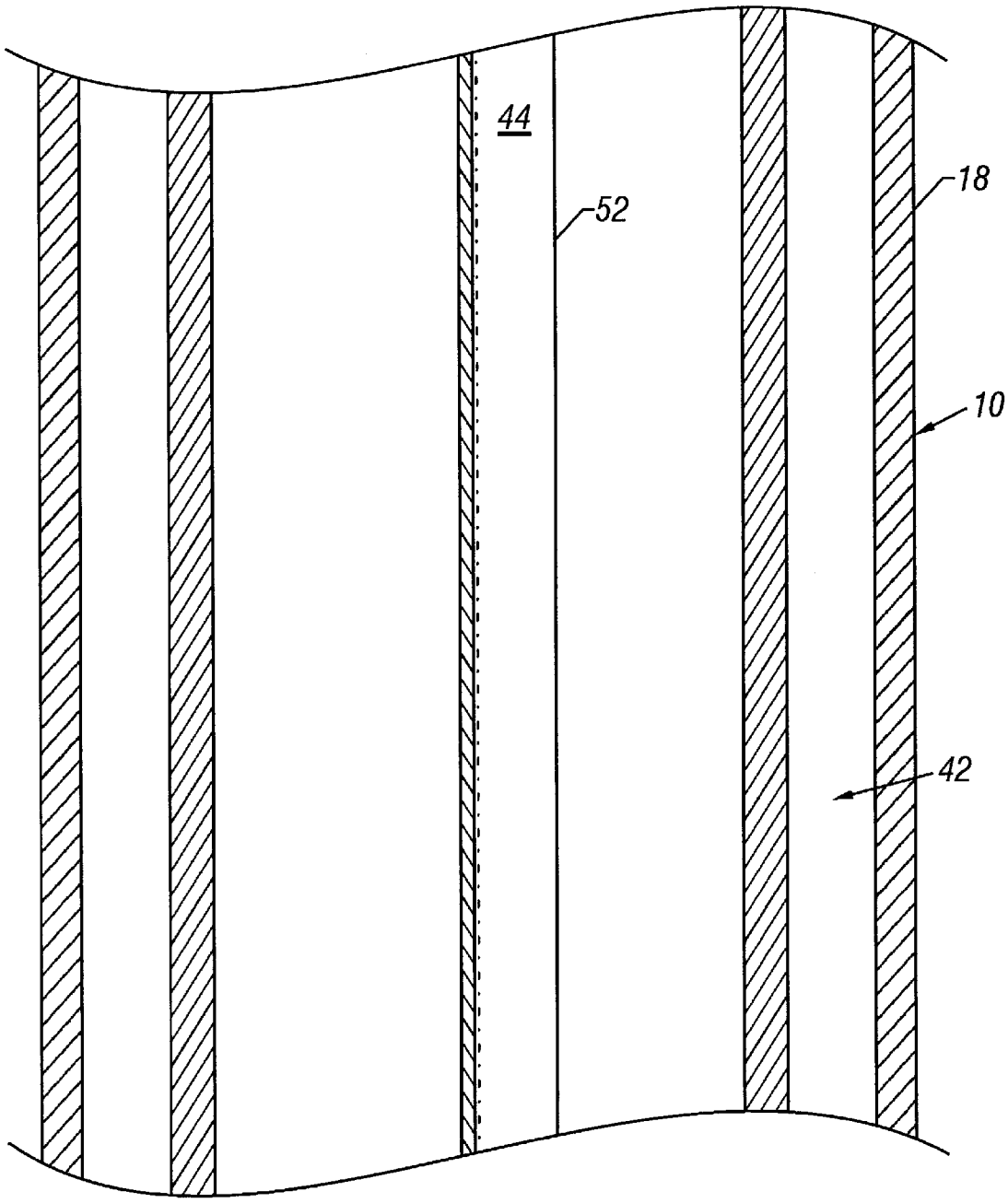
Figure 1L:
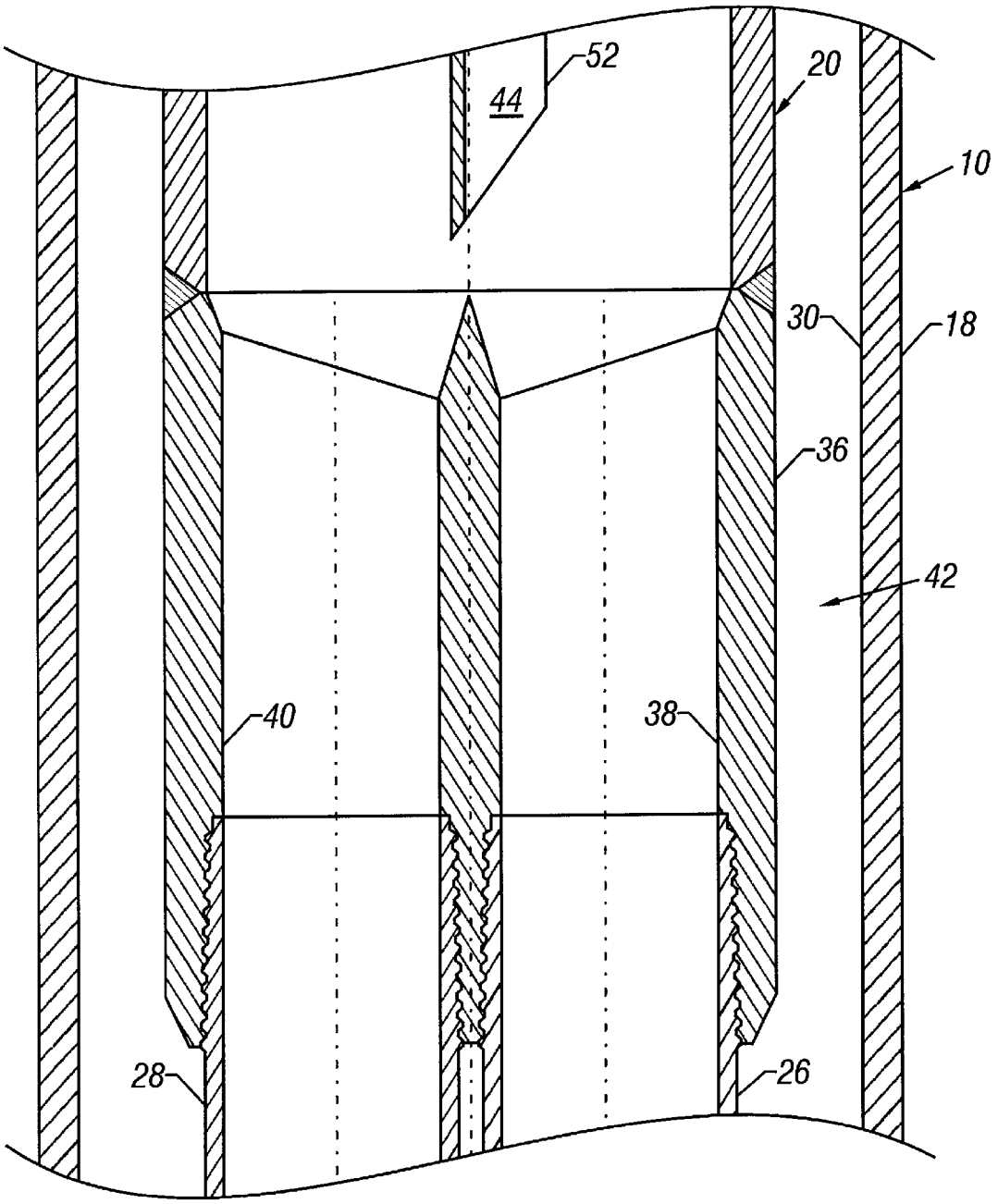

With reference to FIGS. 1A–1L, a tool string 44 is shown disposed within the primary production tubing 20. The tool string 44 shown is of the "slickline" type (i.e., a tool that requires no external power from the surface for operation), but may be of any other type known to those of skill in the art, whether connected to coiled tubing or any type of wireline. As shown in FIG. 1A, the tool string 44 is suspended by a wireline 74 (or coiled tubing), upon which the tool string 44 is deployed, operated, and retracted from the wellbore. One of ordinary skill in the art will understand that the present invention may be used with equal ease for coiled tubing tools, electric line (commonly called "e-line") tools, or any well known service tool string that may be deployed on wireline or coiled tubing in a well having multiple tubings or lateral branches 26 and 28 (see FIG. 1L). The function of intervention tool strings is highly varied, and varieties of such strings may be as simple as a temporary plug used to retain pressure, a pressure/temperature recording device, or as complex as a wireline-conveyed perforating gun. The attributes of the many varied functional embodiments of intervention tool strings is not important to the broad aspect of this invention, since the broad aspect, as taught may be applied to any type of intervention service tool. The essential feature of the invention is the manner in which any generic tool string 44 may be adapted to select, orient, engage, and deploy from the primary production tubing 20 to a desired tubing branch, such as a first or second branch 26 or 28 (see FIG. 1L).

Figure 2A:
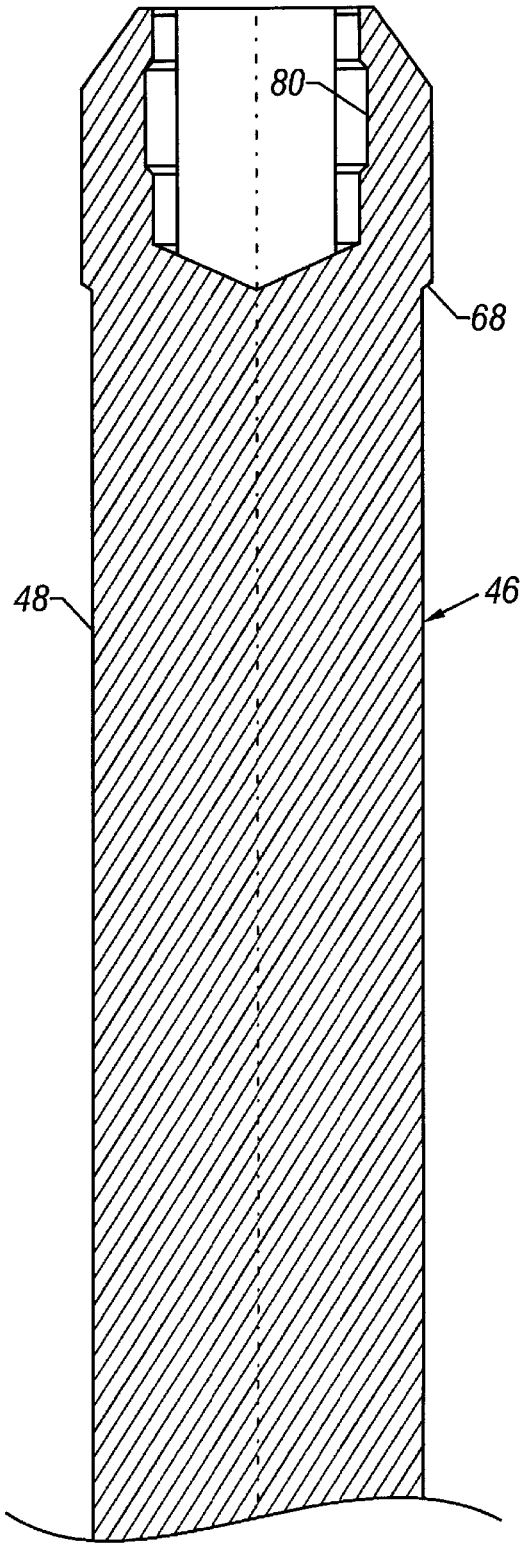
FIGS. 2A–2C illustrates a preferred embodiment of the present invention in longitudinal cross-section taken at a 90-degree angle to the longitudinal cross-section of FIGS. 1A–1H.
Figure 2B:
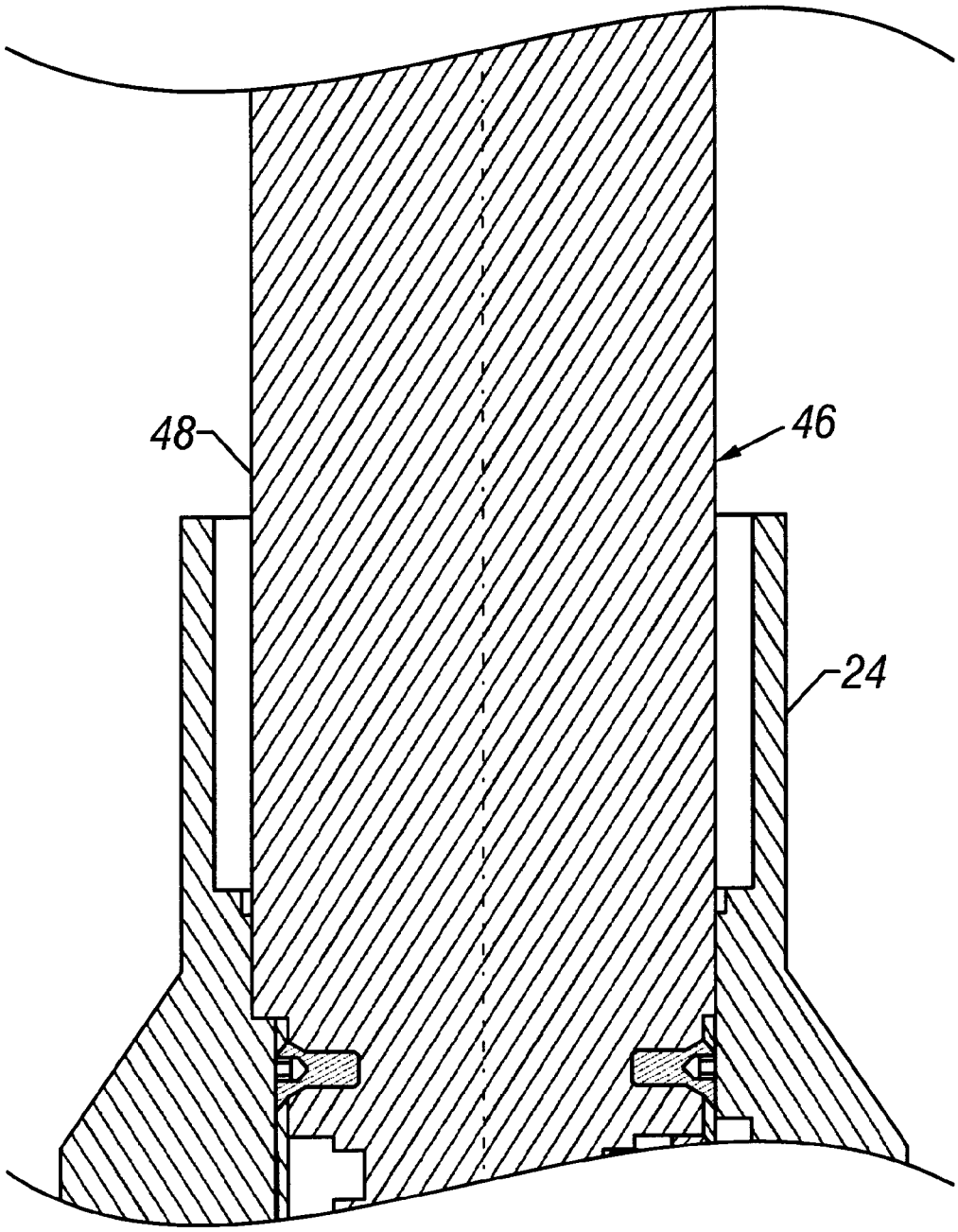

With reference to FIGS. 1G–1I and 3, a selective re-entry tool 46 of the present invention may generally comprise an elongated carrier body 48 having a first navigation port 50 extending therethrough, and a guide bar 52. Referring now to FIGS. 2A–2C and 3, the body 48 may also include a dog 54 movably disposed in a first dog recess 56, and an orienting key 60 pivotally biased radially outward. In a specific embodiment, the dog 54 and/or the orienting key 60 may be spring loaded. The orienting key 60 may be disposed within a first key recess 62 in the body 48, and may be hingedly secured to the body 48 about a hinge pin 61 attached to the carrier body 48. The dog 54 is releasably engageable with a locking recess 72 in the orienting sub 24, and the key 60 is releasably engageable with an discriminator groove 70 in the orienting sub 24. The orienting key 60 and the dog 54 may each be retained by covers 66. As shown in FIG. 2A, the body 48 may further include a no-go process 68 for cooperable engagement with the no-go shoulder 32 on the nipple 22 (see FIG. 1G), in a manner that will be more fully described below.

Figure 2C:
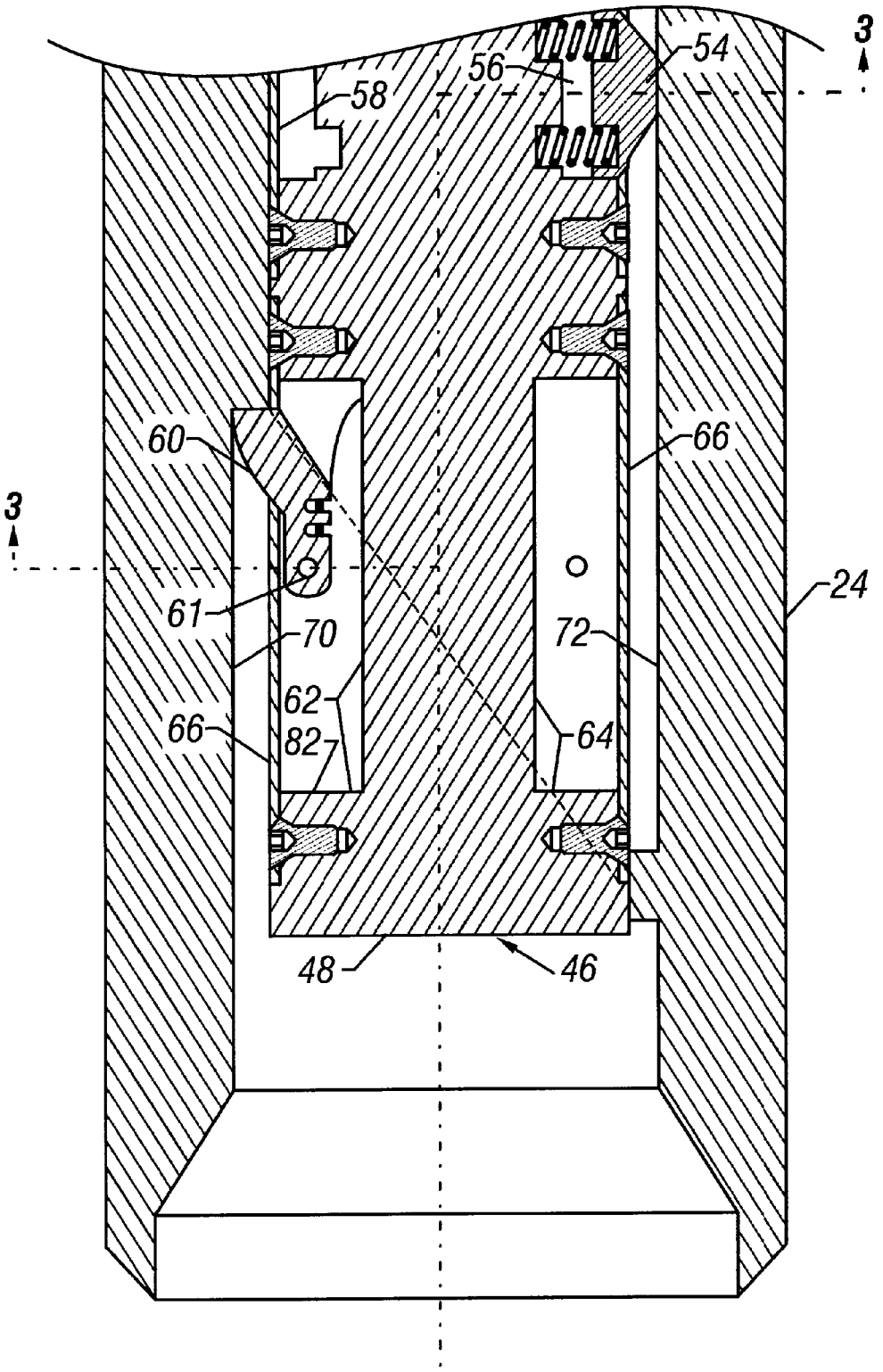
Figure 3:
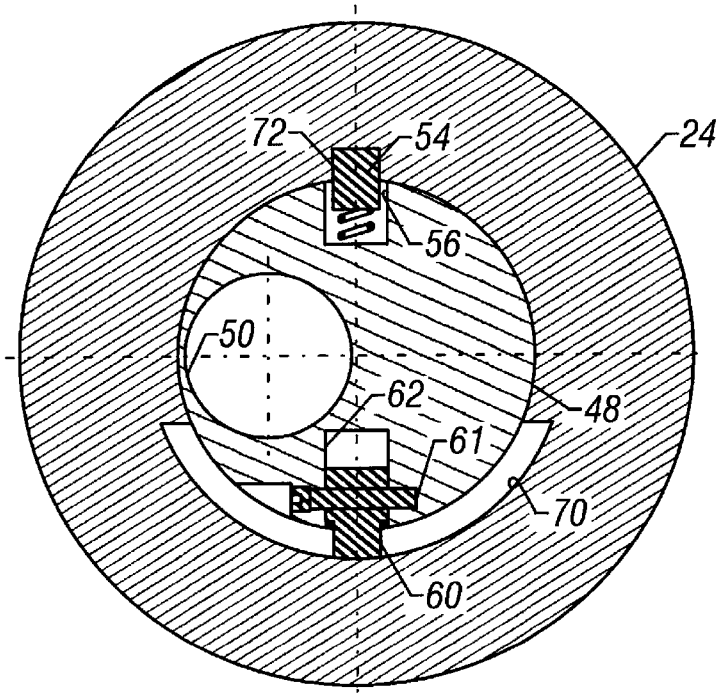
FIG. 3 is a displaced cross-sectional view taken along line 3—3 of FIG. 2.

As shown in FIG. 2C, the body 48 may further include a second dog recess 58, which may be positioned directly opposite the first dog recess 56, and a second key recess 64, which may be positioned directly opposite the first key recess 62. As will be more fully explained below, the dog 54 may be moved from the first dog recess 56 to the second dog recess 58, and the orienting key 60 may be moved from the first key recess 62 to the second key recess 64, in order to provide a different alignment position of the navigation port 50 relative to the first and second branch tubings 26 and 28. In this regard, when the dog 54 is located in the first dog recess 56, and the orienting key 60 is located in the first key recess 62, as best shown in FIGS. 2C and 3, the first navigation port 50 is axially aligned with the first branch tubing 26 (see FIG. 1I). As such, the selective re-entry tool 46, which is held within the first navigation port 50 (see FIGS. 1G–1I), is positioned directly above the first branch tubing 26, and may now be guided, upon movement downhole, directly into the first branch tubing 26 and further downward to its ultimate destination in the well to conduct wireline operations therein. A principal advantage of the present invention is that intervention procedures can be performed in a single "trip" into the well, whereby the tool string 44 and selective re-entry tool 46 are inserted into and retracted from the well as a single unit, and by a single "trip."

In the event it is desired to conduct operations in the second branch tubing 28, then the wireline tool 44 and selective re-entry tool 46 are retracted to the earth's surface, at which time the dog 54 (see FIG. 2C) may be moved from the first dog recess 56 to the second dog recess 58, and the orienting key 60 may be moved from the first key recess 62 to the second key recess 64. Then, when the wireline tool 44 and selective re-entry tool 46 are deployed back into the production tubing 20 and into engagement with the orientation sub 24, the body 48 will be rotated 180 degrees relative to its previous position, so that the first navigation port 50 will be aligned with the second branch tubing 28. Alternatively, instead of moving the dog 54 and key 60 from one recess to another, the dog 54 and key 60 may be kept in their positions as shown, and an adjustable sleeve, or sub, may be rotated at the earth's surface to enable selective re-entry of the second branch tubing 28. The operation of the tool 46 of the present invention, and the manner in which it is lowered into and set within the production tubing 20, will now be explained in more detail.

Once it is decided which branch is to be entered, the selective re-entry tool 46 is assembled in the configuration to enable alignment with the selected branch. The tool 46 is then lowered into the well on a wireline 74 (FIG. 1A) until its no-go process 68 (FIG. 2A) lands on the no-go shoulder 32 on the nipple 22 (FIG. 1G), thereby preventing further downhole movement of the carrier body 48. This allows the orienting key 60 to deploy radially outwardly into the discriminator groove 70. An upward force is then applied to the wireline 74, thereby moving the selective re-entry tool 46 uphole. Upward movement of the tool 46 brings the orienting key 60 into engagement with the discriminator groove 70, which causes the selective re-entry tool 46 to be rotated towards its desired orientation. Further upward movement of the tool 46 rotates the first navigation port 50 over the desired lateral branch 26 or 28, at which time the dog 54 snaps into the locking recess 72 in the body 48, thereby preventing any further rotational movement of the selective re-entry tool 46. The tool string 44 is now positioned directly over the desired branch tubing, whereby "slacking off" tension on the wireline 74 allows the tool string 44 to be lowered downhole to its ultimate service location in the well. It is noted that if the tool string 44 is being run in on coiled tubing, it may be necessary to apply a load to the coiled tubing to force the tool string 44 downwardly. The tool string 44 is now separated from the carrier body 48, which remains in position in the orienting sub 24. The carrier body 48 is prevented from further downhole movement by the co-action of the mechanical stop, such as the no-go shoulder 32 with the no-go process 68.

When remediation operations have been completed, removal of the tool string 44 and the carrier body 48 is initiated by pulling up on the wireline 74 (or coiled tubing) to move the tool string 44 from its service location in the tubing branch 26 or 28 uphole and back through the Y-block adapter 36. With reference to FIG. 1G, upward movement continues until a tool string shoulder 76 contacts a cooperating pick-up recess 78 within the navigation port 50 in the carrier body 48. Further tension on the wireline 74 (or coiled tubing) causes the tool string 44 and the carrier body 48 to simultaneously move toward the surface until the orienting key 60 comes into contact with a shearing shoulder on the carrier body 48 (see FIG. 2C). The wireline 74 (or coiled tubing) is then pulled upwardly with a force sufficient to shear the pin 61 and push the orienting key 60 downwardly within the key recess 62 or 64. If the occurrence of unexpected problems necessitates removal of the carrier body 48 from the well without the tool string 44, a fishing neck 80 (see FIGS. 1G and 2A) is provided for engagement with common and well known pulling tools.

One skilled in the art will recognize that the substitution of a different carrier body 48 with a navigation port 50 in a distinctly different orientation will likewise enable an orientation change. In this altered embodiment, the selective re-entry tool 46 would achieve the identical result of lateral branch selection by changing out the carrier body 48 instead of reassembly of the orienting key 60 and the dog 54. A variety of lateral branch selections can be attained by installing any of a variety of carrier bodies having the desired navigation port orientation. To modify the selective re-entry tool 46 in this manner would still be within the scope and spirit of the present invention.

One of ordinary skill in the art will understand that the total number of lateral wellbores, orientations and angles to attain intervention entry to any of a plurality desired lateral branches will vary with the number of lateral branches that are required in the completion scheme. The embodiment illustrated shows only two branches 26 and 28. This is done to simplify the drawings and should not be taken as a limitation. Any number of lateral wellbores may be entered using the selective re-entry tool 46 of the present invention, limited only by any geometric constraints inherent in the primary production tubing 20 at the Y-block adapter 36. For example, where the well has a third lateral branch with a specific orientation, a third key recess and a third dog recess would be formed in the carrier body 48 matching that orientation. Assembly by the operator at the earth's surface of the orienting key 60 in the third key recess and the spring-loaded dog 54 in the third dog recess would assure alignment of the first navigation port 50 with the third lateral branch. When inserted in the well thus configured, the selective re-entry tool 46 would then be oriented such that the first navigation port 50 would be directly over the third branch tubing. This would enable the tool string 44 access to the third branch tubing, and simultaneously prohibit access to the first and second branch tubings 26 and 28. In such an embodiment, no additional parts are necessary to attain a different selection of lateral branches to be entered thereby minimizing the cost of the tool. Alternatively, and as discussed hereinabove, it is within the scope of the present invention that the third lateral branch may also be selected by installing a different carrier body 48 having the desired navigation port 50 orientation.

The description above details one embodiment for locating, orienting, and locking the carrier body in a specific location in the well. Well known in the art are several examples of selective locating and locking tools, such as the OTIS "X" and "R" locks, Camco "DB" and "C" locks, as well as several examples of Petroline locking devices. These devices all employ locating and locking mechanisms for engagement with a downhole profile. On some locks a no-go shoulder locates and a moveable dog locks the device to a downhole profile. In some others, a spring-loaded key provides both locating and locking functions. It would be within the scope of the present invention to adapt the locating and locking mechanisms on a known locking device to locate and/or lock the selective re-entry tool of the present invention.

Figure 4:
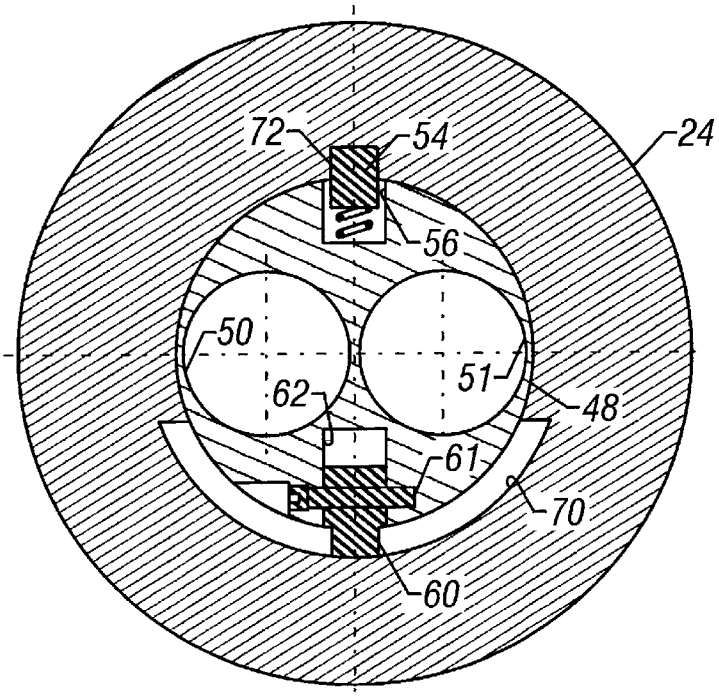
FIG. 4 is a cross-sectional view similar to FIG. 3 showing an alternate embodiment of the present invention.

An alternative embodiment of the present invention is shown in FIG. 4. Referring now to FIG. 4, a generally radial arrangement and relationship of the orienting key 60, the first key recess 62, the dog 54, the first dog recess 56, the first navigation port 50, and a second navigation port 51, are shown. The integral locking recess 72 and orienting groove 70 in the orienting sub 24 are also clearly illustrated. In this specific embodiment, the first navigation port 50 is aligned with the first branch tubing 26, while prohibiting access to the second branch tubing 28. The second navigation port 51 is aligned with the second branch tubing 28, while prohibiting access to the first branch tubing 26. The tool string 44, held in place in the first navigation port 50, is now able to be guided, upon movement thereof downhole, directly into the first branch tubing 26 and further downward to its ultimate destination in the well. Should it be desired to direct the tool string 44 into the second branch tubing 28, in this alternate embodiment, the tool string 44 may be positioned in the second navigation port 51 (or third navigation port if required) without the need to reverse the positions of the dog 54 and the orienting key 60. When inserted in the well in this configuration, the selective re-entry tool 46 is oriented such that the tool string 44 is positioned directly over the second branch tubing 28. This allows the tool string 44 access to the second branch tubing 28, while simultaneously prohibiting access to the first branch tubing 26. In this embodiment, the number of navigation ports is limited only by the orientation requirements of the plurality of lateral branches in the completion scheme, and should not be considered as a limitation.

From the above description, it is now apparent that the present invention has been contemplated to overcome the deficiencies of previously proposed tools and meet the above-described needs by providing a device that has the ability to discriminate between lateral branch tubing strings running from a primary production tubing string. Further, the present invention will reliably orient the tool string 44 so that it may enter a desired lateral branch, especially where the tubing entry point is at a depth below the wellhead. Finally, the present invention accomplishes discrimination and selection functions with a simple surface modification to the intervention tool that eliminates the need for a "tie-back" tubing string for intervention operations. In this manner, cost savings in the design, implementation, and operation of the well are realized.

Whereas the present invention is not limited to the exact details of construction, operation, exact materials or embodiments shown and described, as obvious modifications and equivalents will be apparent to one skilled in the art. Whereas the present invention has also been described in relation to the drawings attached hereto, it should be understood that other and further modifications, apart from those shown or suggested herein, may be made within the scope and spirit of the present invention.

What is claimed is:

1. A selective re-entry tool for use in a tubing string having a plurality of branch tubings, the re-entry tool comprising:

a carrier body having a navigation port extending longitudinally therethrough; and an orienting key movably connected to the carrier body and releasably engageable with a discriminator groove in the tubing string to align the navigation port with a predetermined one of the plurality of branch tubings.

2. The selective re-entry tool of claim 1, wherein the orienting key is adapted to be removably disposed within one of a plurality of key recesses in the carrier body, the identity of the predetermined one of the plurality of branch tubings alignable with the navigation port depending on which of the plurality of key recesses the orienting key is disposed in.

3. The selective re-entry tool of claim 1, wherein the orienting key is hingedly connected to the carrier body.

4. The selective re-entry tool of claim 1, wherein the orienting key is outwardly biased by a spring.

5. The selective re-entry tool of claim 1, further including a locking dog movably connected to the carrier body and releasably engageable with a locking recess in the tubing string to prevent rotation of the carrier body after the navigation port has been aligned with the predetermined one of the plurality of branch tubings.

6. The selective re-entry tool of claim 5, wherein the locking dog is adapted to be removably disposed within one of a plurality of dog recesses in the carrier body.

7. The selective re-entry tool of claim 5, wherein the locking dog is outwardly biased by a spring.

8. The selective re-entry tool of claim 5, wherein the engagement of the locking dog and the locking recess prohibits further rotation of the carrier body relative to the tubing string and permits limited longitudinal movement of the carrier body relative to the tubing string.

9. The selective re-entry tool of claim 1, further including a guide bar extending from the carrier body in alignment with the navigation port.

10. The selective re-entry tool of claim 1, wherein the carrier body further includes a no-go process cooperably engageable with a no-go shoulder in the tubing string.

11. A method for inserting a well tool in a selected one of a plurality of branch tubings in a tubing string, comprising:

connecting an orienting key to a carrier body, the carrier body having at least one navigation port extending longitudinally therethrough;

positioning the carrier body in the tubing string;

engaging the orienting key with a discriminator groove in the tubing string;

rotating the carrier body to align the at least one navigation port with the selected one of the plurality of branch tubings; and passing the well tool through the navigation port and into the selected one of the plurality of branch tubings.

12. The method of claim 11, further including:

attaching a locking dog to the carrier body; and engaging the locking dog with a locking recess in the tubing string to maintain alignment between the at least one navigation port and the selected one of the plurality of branch tubings.

13. The method of claim 11, further including:

pulling the well tool up into the navigation port;

removing the carrier body and well tool from the tubing string;

disconnecting the orienting key from the carrier body;

connecting the orienting key to a different position on the carrier body;

positioning the carrier body back into the tubing string;

engaging the orienting key with the discriminator groove in the tubing string;

rotating the carrier body to align the at least one navigation port with another selected one of the plurality of branch tubings; and passing the well tool through the navigation port and into the another selected one of the plurality of branch tubings.

14. A selective re-entry tool for use in a tubing string having a plurality of branch tubings, the re-entry tool comprising:

a carrier body having a plurality of navigation ports extending longitudinally therethrough, the number of navigation ports being equal to the number of branch tubings; and an orienting key movably connected to the carrier body and releasably engageable with a discriminator groove in the tubing string to align the plurality of navigation ports with the plurality of branch tubings.

15. The selective re-entry tool of claim 14, further including a locking dog movably connected to the carrier body and releasably engageable with a locking recess in the tubing string to prevent rotation of the carrier body after the plurality of navigation ports has been aligned with the plurality of branch tubings.

16. The selective re-entry tool of claim 15, wherein the engagement of the locking dog and the locking recess prohibits further rotation of the carrier body relative to the tubing string and permits limited longitudinal movement of the carrier body relative to the tubing string.

17. The selective re-entry tool of claim 15, wherein the locking dog is outwardly biased by a spring.

18. The selective re-entry tool of claim 14, wherein the carrier body further includes a no-go process cooperably engageable with a no-go shoulder in the tubing string.

19. The selective re-entry tool of claim 14, wherein the orienting key is hingedly connected to the carrier body.

20. The selective re-entry tool of claim 14, wherein the orienting key is outwardly biased by a spring.

* * * * *